US008206049B2

(12) United States Patent
Thiebaut

(10) Patent No.: US 8,206,049 B2
(45) Date of Patent: Jun. 26, 2012

(54) PACKAGING ITEM

(75) Inventor: Laure Thiebaut, Clichy (FR)

(73) Assignee: L'Oreal, Paris (FR)

( * ) Notice: Subject to any disclaimer, the term of this patent is extended or adjusted under 35 U.S.C. 154(b) by 95 days.

(21) Appl. No.: 12/488,255

(22) Filed: Jun. 19, 2009

(65) Prior Publication Data

US 2009/0317171 A1 Dec. 24, 2009

Related U.S. Application Data

(60) Provisional application No. 61/080,569, filed on Jul. 14, 2008.

(30) Foreign Application Priority Data

Jun. 20, 2008 (FR) ..... 08 03463

(51) Int. Cl.
*A46B 17/08* (2006.01)

(52) U.S. Cl. ..... 401/122; 401/121

(58) Field of Classification Search ..... 401/118, 401/121, 122, 126–130; 220/521, 529, 23.83, 220/23.9, 23.86, 23.87; 206/572, 229, 361
See application file for complete search history.

(56) References Cited

U.S. PATENT DOCUMENTS

| | | | | | |
|---|---|---|---|---|---|
| 583,152 | A | * | 5/1897 | McCollam | 401/121 |
| 969,350 | A | * | 9/1910 | Donaldson | 401/129 |
| 3,298,561 | A | | 1/1967 | McConnie | |
| 4,261,376 | A | | 4/1981 | Kingsford | |
| 4,470,425 | A | * | 9/1984 | Gueret | 132/218 |
| 4,609,300 | A | * | 9/1986 | Robert | 401/122 |
| 5,190,389 | A | * | 3/1993 | Vasas | 401/122 |
| 5,697,720 | A | * | 12/1997 | Lhuisset | 401/122 |
| 6,024,507 | A | * | 2/2000 | Joulia | 401/4 |
| 6,505,632 | B1 | * | 1/2003 | Toll et al. | 132/218 |
| 6,676,320 | B1 | * | 1/2004 | Wainer | 401/122 |
| RE38,698 | E | * | 2/2005 | Joulia | 401/4 |
| 7,044,669 | B2 | * | 5/2006 | Winckels et al. | 401/122 |
| 7,182,535 | B2 | * | 2/2007 | Lim | 401/129 |
| 7,186,044 | B2 | * | 3/2007 | Bailly | 401/122 |
| 7,455,468 | B2 | * | 11/2008 | Gueret | 401/126 |
| 7,946,778 | B2 | * | 5/2011 | Gueret | 401/129 |
| 2007/0231050 | A1 | | 10/2007 | Thiebaut | |

FOREIGN PATENT DOCUMENTS

| | | |
|---|---|---|
| EP | 1 836 921 | 9/2007 |
| FR | 07-57116 | 2/2009 |

OTHER PUBLICATIONS

U.S. Appl. No. 12/488,225, filed Jun. 19, 2009, Thiebaut.

* cited by examiner

*Primary Examiner* — David J. Walczak
*Assistant Examiner* — Jennifer C Chiang
(74) *Attorney, Agent, or Firm* — Oblon, Spivak, McClelland, Maier & Neustadt, L.L.P.

(57) ABSTRACT

A packaging item for a cosmetic product includes a receptacle provided with an opening and a plate mounted on the receptacle and carrying at least one wiping member, the wiping member being displaceable in a slot or a port of the plate to occupy different positions in the opening of the receptacle, the positions allowing product to be removed with an applicator from different zones of the receptacle.

20 Claims, 6 Drawing Sheets

PACKAGING ITEM

CROSS-REFERENCE TO RELATED APPLICATIONS

This document claims priority to French Application Number 08/03463, filed Jun. 20, 2008 and U.S. Provisional Application No. 61/080,569, filed Jul. 14, 2008, the entire contents of each of which are hereby incorporated by reference.

FIELD OF THE INVENTION

The present invention relates to a packaging item, for example for a cosmetic product, and to a method for using the packaging item.

BACKGROUND OF THE INVENTION

Discussion of Background

In the present application, the term "cosmetic product" means a product as defined in Council Directive 93/35/CEE dated 14 Jun. 1993.

In the related art, a packaging item for a cosmetic product includes a receptacle having an opening for distribution of a cosmetic product, the width of which depends in particular on the characteristics of the cosmetic product. In the case in which the cosmetic product is in the form of a mousse, for example, the opening of the receptacle via which the receptacle is filled is relatively wide so that the structure of the mousse is not modified on filling. Such a receptacle is generally wider than it is high.

French patent application FR-07/57116 proposes equipping a wide opening receptacle with a plurality of wiping members, each wiping member defining an orifice through which an applicator can pass to remove a quantity of product from the receptacle. The wiping members are supported on a plate which is fixedly mounted on the receptacle and which closes the opening of the receptacle. That plate includes a large number of wiping members distributed in a manner which allows the cosmetic product to be removed from any point of the receptacle using the applicator. The consumer using the receptacle has to select a wiping member for removing the product and then to pass the applicator through that member.

However, it has been observed that the consumer is confused by the large number of wiping members on the plate and does not know which one to use. It is in fact difficult or even impossible to see, through the orifices for passage of the wiping members, where the regions are in the receptacle where sufficient product remains. Further, for cost and simplicity reasons, the plate and the wiping members are formed from a single piece. However, the plate is preferably relatively rigid and the wiping members are more flexible, which complicates the choice of the material for the part. It would be possible to produce that part from two materials, but this would result in a part which was more complex and more expensive to produce.

Document U.S. Pat. No. 3,298,561 discloses a paint can equipped with a cover comprising means for wiping the bristles of a paintbrush, said wiping means possibly comprising two arms one of which is fixed and the other of which is movable and pivotably mounted on the cover so that the arms can be moved away from or towards each other. However, those arms define between them a section for removing paint from the pot which varies as a function of the position of the movable arm, and which cannot be precisely adjusted in order to remove a predetermined quantity of paint from the pot. Further, the zone for removing paint from the pot is substantially permanently located in the center of the pot, and it is difficult to remove paint with a paintbrush from the periphery of that pot. Further, the arms do not guide the paintbrush when paint is being removed from the pot.

SUMMARY OF THE INVENTION

One or more examples of the present invention aims to provide a simple, effective and economical solution to the disadvantages of the prior art.

In one example of the invention, a packaging item, for example for a cosmetic product, includes a receptacle provided with an opening and a plate mounted on the receptacle and carrying at least one wiping member through which an applicator may be passed to remove product from the receptacle. In an example, the wiping member can be displaceable in a slot or a port of the plate in order to occupy different positions in the opening of the receptacle, said positions allowing product to be removed with the applicator from different zones of the receptacle.

Examples of the invention related to a packaging item, the receptacle of which, has a wide opening. In one or more examples, the term "wide opening" of a receptacle means an opening the diameter or transverse dimension of which is substantially equal to the internal diameter or the transverse dimension of the receptacle. In an example, the opening may be in the range from approximately 70% to 100% of the diameter or the transverse dimension. In an example, a wide opening of a receptacle may have a section in the range 25 to 400 times the cross-section of the shaft of an applicator intended to be used with this receptacle. The receptacle opening may be circular or non-circular in shape, for example polygonal.

In the packaging item of one or more embodiments of the invention, the wiping member can be displaceable in a slot or a port of the plate and may be brought into a plurality of different positions over the product contained in the receptacle. For example, this wiping member can be displaceable across the slot or port. Thus, the wiping member can be used to remove product from a plurality of zones in the receptacle and not simply in a single zone as is the case with the prior art. The number of wiping members carried by the plate may be considerably reduced and is, for example, in the range one to ten, preferably in the range one to three, as opposed to up to 60 in the prior art described in application FR-07/57116.

The consumer of the packaging item of the invention thus no longer has any difficulty in selecting a wiping member of the plate. In an example, the small number of wiping members also means that the zones in the receptacle where there is product and the quantity of product in these zones can be better discerned. The consumer can thus see the product in the receptacle through the plate if this is formed from a transparent or translucent plastic material, or directly through the opening of the receptacle if the plate does not cover the whole of the opening. In an example, the wiping member may be produced independently of the plate and be attached to and mounted on the plate.

In one example, the wiping member defines a constant applicator wiping section. This section can be defined by a border with a closed contour and may have a circular, square, oval, polygonal or any shape which cannot be modified. In a further example, the wiping section defined by the member may be enlarged, shrunk or deformed, for example by displacing this member in the slot or the port of the plate.

The wiping members can be also advantageously designed to guide the applicator or at least a portion thereof in displacement (especially in translation).

In accordance with another embodiment of the invention, the wiping member can be movable in the slot or port of the plate in at least one direction. For example, the wiping member is displaceable in a plane which is substantially perpendicular to the axis of the opening of the receptacle. In one or more examples of the present invention, the term "axis of the opening of the receptacle" means an axis which extends in the direction of the opening of the receptacle, i.e. its product distribution opening. This axis may pass through the center of this opening and may be a longitudinal axis of the receptacle. In an example, the opening axis may be secant, in particular orthogonal, to a transverse plane of the receptacle or to a plane passing through the free edge of a neck of the receptacle. The wiping member may be displaceable in rotation and/or in translation on the plate.

In an embodiment, the wiping member can be guided by the port or the slot passing through the plate. The plate may include at least one slot or port which is substantially radial with respect to the axis of the opening of the receptacle. In an example, three radial slots are distributed in a regular manner about the receptacle opening axis. In an example, the plate includes at least two parallel slots at a distance from each other, one wiping member being guided in each of these slots. In yet another embodiment, the plate includes a plurality of slots which are connected together such that at least one wiping member can be displaced from one slot to another of the plate.

In an example, the wiping member may include a ring for mounting the member in the slot of the plate, said ring can be engaged by elastic snap-fitting in the slot and be slidably supported on the opposed faces of the plate.

In a variation, the wiping member includes two parallel outer annular rims spaced from each other, one of these rims can be slidably supported on one face of the plate, and the other of said rims can be in sliding support on another opposed face of the plate or to be engaged in a slidable manner in an inner groove of an edge of the plate defining the slot.

In one embodiment, the plate can be displaceable in translation and/or in rotation on the receptacle in a plane which is substantially perpendicular to the receptacle opening axis. In the case in which the receptacle forms a drum extending about an axis of revolution, the plate is preferably movable in rotation about said axis of revolution.

The wiping member is thus displaceable with respect to the plate which itself is displaceable with respect to the receptacle. This means that the member can occupy a multitude of different positions in the opening of the receptacle, and thus product can be removed from any region in the receptacle. Displacement of the member on the plate and of the plate on the member may be carried out manually by the consumer.

In a further example, the plate may include an annular rim surrounding a neck of the receptacle and include an inner annular bead which is engaged by elastic snap-fitting into an outer annular groove of the neck of the receptacle and which can slide in said groove.

In a variation, the plate may include two parallel and opposed lateral rims including pins which face each other, which are engaged by elastic snap-fitting in parallel grooves on a neck of the receptacle and which can slide in said grooves.

In one or more examples, the plate may have a circular, square, rectangular or other outer contour and covers part or all of the receptacle opening. The plate can be produced from a transparent or translucent material so that a consumer can see the product contained in the receptacle through the plate.

One or more embodiments of the present invention also concerns a method for using a packaging item, which includes displacing the wiping member over a zone for removing product from the receptacle, introducing an applicator into the wiping member in order to remove product from the receptacle, and taking the applicator from the wiping member. The member may be displaced over the product contained in the receptacle by displacing the member on the plate and by displaceable the plate on the receptacle.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

DETAILED DESCRIPTION OF THE PREFERRED EMBODIMENTS

Figure 1:
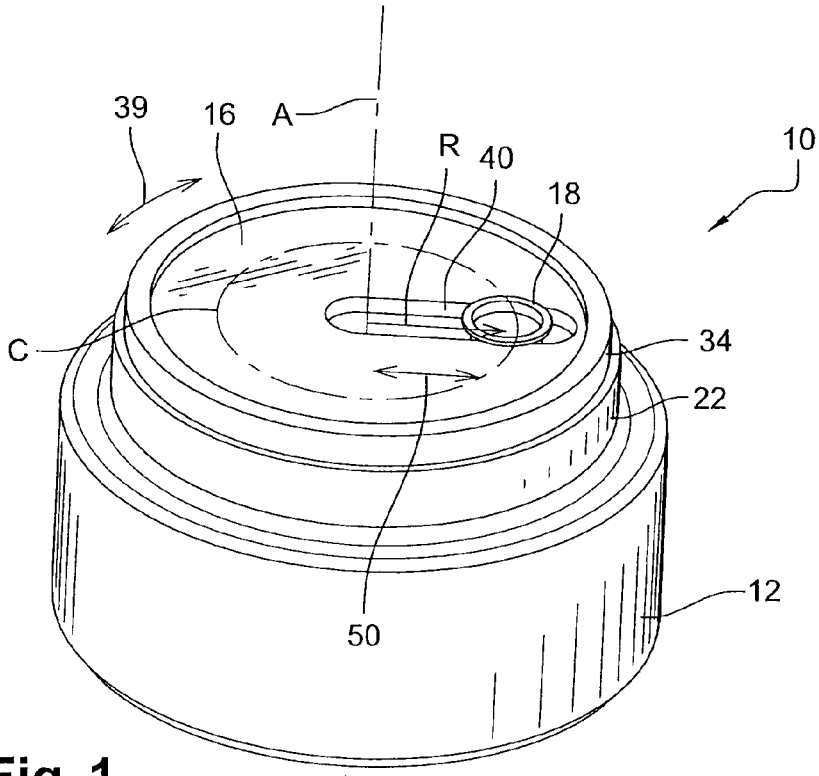
FIG. 1 is a diagrammatic perspective view of a packaging item of one example of the invention.

Referring now to the drawings, like reference numerals are utilized to designate identical or corresponding parts throughout the several views.

Initially, reference will be made to FIGS. 1 to 4 which show a packaging item 10 for a cosmetic product of one or more examples of the invention. The packaging item 10 includes a receptacle 12 containing a cosmetic product 14 for example and a plate 16 on which a wiping member 18 is mounted in a movable manner through which an applicator 20 can pass to remove a quantity of product contained in the receptacle.

The receptacle 12 includes at its upper end a neck 22 defining an opening 24 for distribution of product and having an external thread 26 for screwing on a lid (not shown) for sealing the receptacle closed.

In the example shown, which is not in any way limiting, the receptacle 12 is generally cylindrical in shape and is of the wide neck 22 variety or wide opening variety 24. In an example, the diameter or the transverse dimension of this opening 24 is substantially identical to the internal diameter or to the internal transverse dimension of the receptacle 12. The diameter of the opening 24 is, for example, in the range from approximately 20 to 100 mm. The opening 24 here acts both for filling the receptacle and for distribution of the cosmetic product.

An axis A can be defined as the axis of opening 24 of the receptacle, this axis passing through the center of the opening and being identical with the longitudinal axis of the receptacle 12 in the example shown. The opening 24 here has a circular cross section, for example.

The cosmetic product 14 may be a makeup product selected from a mascara, a foundation, a nail polish, a concealer, an eyeliner, a gloss, a lipstick, a blusher, an eyeshadow, etc. This product, for example, has a viscous consistency, such as a gel, cream, oil, mousse, wax, paste, etc. This product may also be a care product such as an antiwrinkle or concealing preparation or a skin treatment product. It should be appreciated that the receptacle can contain any desirable product.

Figure 4:
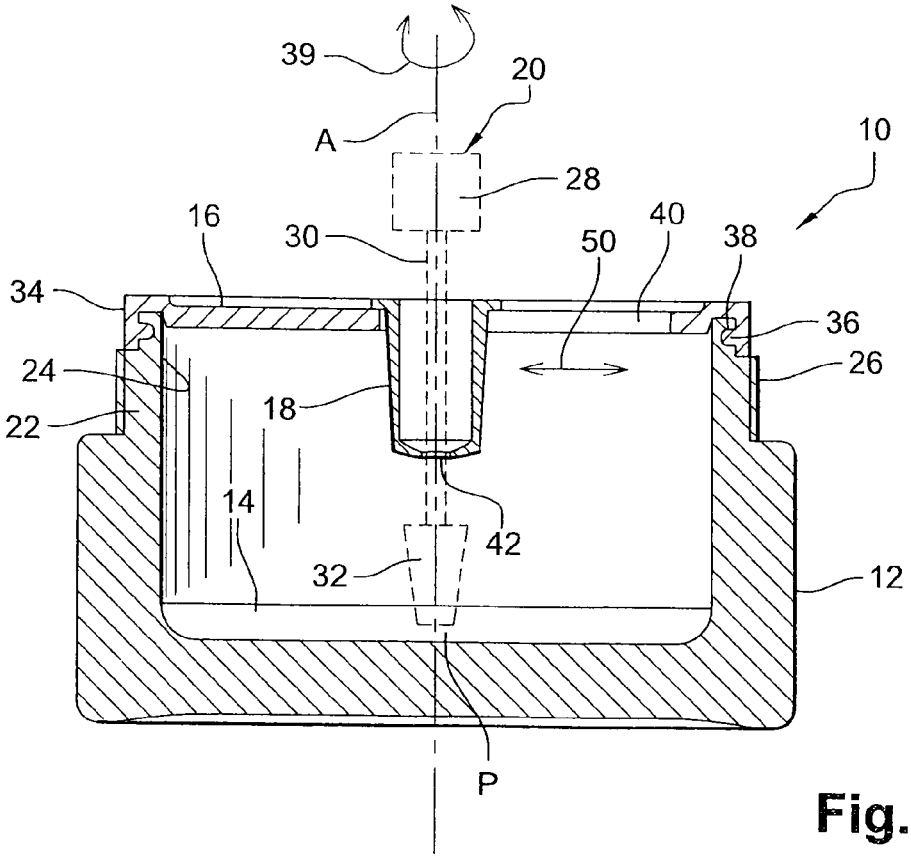
FIG. 4 is a sectional view along line IV-IV' of FIG. 2.

The applicator 20 shown in broken lines in FIG. 4 includes, for example, a handle 28 which can be fixed to one end of a shaft 30 the other end of which carries an appropriate rigid or flexible tip 32 such as for example, an injected or twisted core brush, a paintbrush, a threaded shaft, a spatula, a comb, an open and/or closed cell foam, a flocked or piled tip, etc. In an example, the shaft of the applicator 20 may be substantially cylindrical and have an external diameter of approximately 5 mm. The applicator 20 is, for example, of the type described in application FR-07/57116. Product 14 may be removed through the wiping member 18 by rotating the tip 32 one or more times when it is in contact with the product or immersed therein, or by pumping, i.e. with small to-and-fro movements of the tip in the product.

The plate 16 here can be formed as a disk which covers the whole of the opening 24. The plate 16 is movably and removably mounted on the receptacle 12 and includes at its outer periphery an annular rim 34 which extends to the side of the receptacle 12 and which is engaged on an upper end portion of the neck 22 of the receptacle by elastic snap-fitting. The rim 34 may have an inner annular rim 36 which is engaged in an outer annular groove 38 of the neck of the receptacle. The plate 16 is displaceable in rotation on the receptacle about the axis A by sliding of the bead 36 in the groove 38 of the neck (arrows 39). The bead 36 is engaged in this groove 38.

The plate 16 is, for example, produced from a transparent or translucent material so that a consumer can see the product 14 contained in the receptacle through the plate and can locate a zone in the receptacle from which product can be removed.

The plate 16 includes a through port or slot 40 in which the wiping member 18 is guided. In the example shown, the slot 40 extends substantially radially with respect to the axis A from the centre of the plate 16 to a point close to its outer rim 34. The slot 40 is elongate and rectilinear in shape and its longitudinal ends curve inwardly in a concave manner.

The wiping member 18 has a generally tubular shape and includes at its lower end a constriction defining an orifice 42 for passage of the applicator 20 (FIG. 4). The smaller this orifice 42, the smaller is the quantity of product removed by the applicator after removing it from the wiping member 18. The diameter of the orifice 42 may, for example, be in the range 0.001 to 0.5 times, preferably in the range 0.03 to 4 times and more preferably in the range 0.05 to 0.1 times the diameter of the opening 24 of the receptacle. As an example, the orifice 42 may define a wiping section in the range approximately 30 to 300 $mm^2$ when the opening 24 of the receptacle defines a section in the range approximately 700 to 8000 $mm^2$. The member 18 also includes an outer annular rim 44 (FIG. 3) at its upper end.

The wiping member 18 guides the applicator 20 during its insertion into the receptacle and its withdrawal from the receptacle. In the example shown, the orifice 42 of the member forms means for guiding the shaft 30 as well as the tip 32 of the applicator 20 in translation.

A ring 46 can be engaged around the wiping member 18 and is intended to cooperate with the plate 16 to retain the wiping member 18 on the plate 16 and allow this member to be displaced in translation and rotation in the slot 40 of the plate 16. In the mounted position, the wiping member 18 extends into the opening 24 of the receptacle 12 substantially parallel to the axis A.

In the example shown, the ring 46 includes four parallel hooks 48 which extend from one side of the ring 46 and which are distributed regularly about the axis of revolution of the ring 46. In an example, the hooks 48 are substantially L-shaped and each include a tab extending along the axis of revolution of the rim one end of which is connected to the ring 46 with its opposite free end carrying a rim which is orientated outwardly.

In an example, the wiping member 18 and the ring 46 may be mounted in the slot 40 of the plate 16 as follows: the wiping member 18 is engaged axially in the ring 46 until the outer rim 44 of the member bears axially on the side of the ring 46 opposite to the hooks 48. The wiping member 18 may be forcibly engaged in the ring 46 or may be fixed thereon by elastic snap-fitting.

The wiping member 18 is then positioned over the plate 16, parallel to the axis A of the receptacle so that the hooks 48 of the ring 46 are located on the side of the plate. The wiping member 18 is displaced towards the plate 16 in a direction parallel to the axis A until the hooks 48 of the ring 46 pass through the slot, deforming elastically. The ring 46 then bears on the upper face of the plate 16 and the rims of the hooks 48 come to bear on the lower face of the plate 16. The ring 46 and its hooks 48 are then slidably supported on the plate 16. As such, wiping member 18 can be manually displaced in the slot 40 from a position where it is aligned with the axis A (FIGS. 2 and 4) and where it bears on the radially inner, circular arc end of the slot 40 to a position where it is situated close to the outer rim 34 of the plate and where it bears on the radially outer circular end arc of the slot 40 (arrows 50). The position of the wiping member 18 shown in FIG. 1 is an intermediate position between the two positions defined above. The wiping member 18 is also displaceable in rotation in the slot 40 about its axis of revolution.

When the wiping member 18 is aligned with the axis A, it allows product to be removed from the center of the receptacle using an applicator 20. The member 18 can be displaced in the slot into any position. The fact that the plate 16 is displaceable in rotation about the axis A also means that the member 18 is displaceable in rotation about the axis A in the opening 24 of the receptacle. When the member 18 is aligned with the axis A, rotation of the plate 16 on the receptacle does not change the position of the wiping member 18. When the wiping member 18 is in another position, i.e. a position distanced from the axis A by a radius R, as is the case in FIG. 1, rotation of the plate 16 causes displacement in rotation of the member about a circumference C centered on the axis A and with radius R. According to the advantageous features of one or more embodiments, the member 18 can thus be displaced in the opening 24 of the receptacle into any position, which means that product can be removed from any point in the receptacle.

Figure 2:
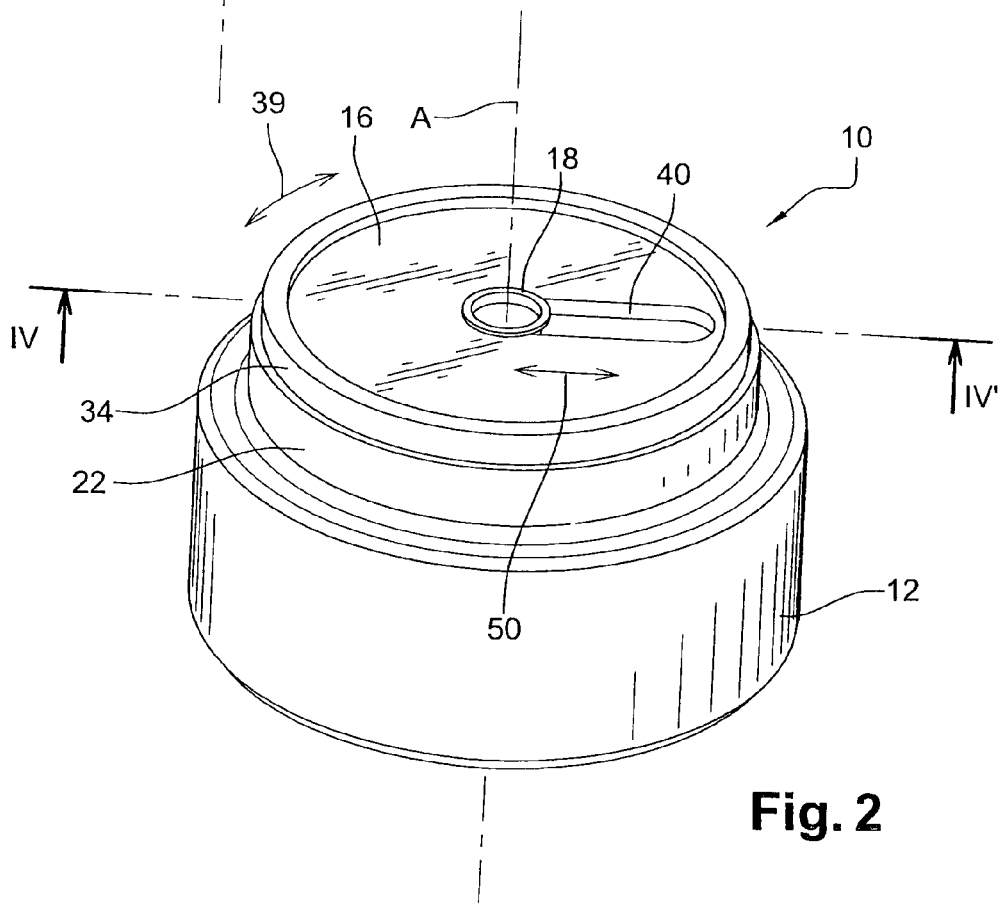
FIG. 2 is a diagrammatic perspective view of the packaging item of FIG. 1.
Figure 3:
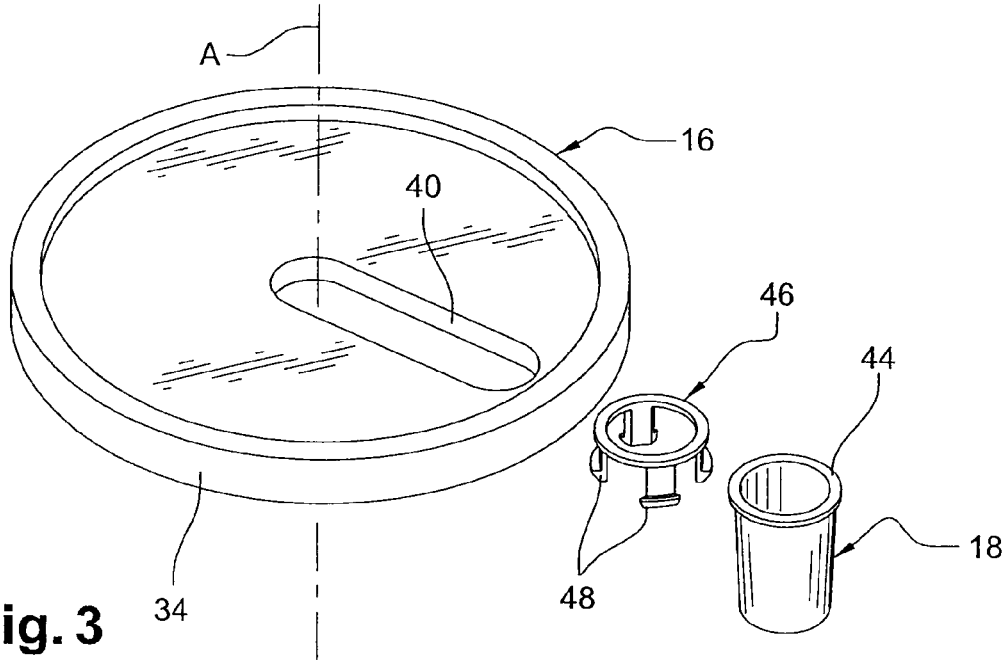
FIG. 3 is an exploded diagrammatic perspective view of the plate and the wiping member of the packaging item of FIG. 1.

As an example, the packaging item 10 shown in FIGS. 1 to 4 may be used as follows: the consumer selects a zone in the product for removing product (especially as a function of the quantity of product remaining in that zone) and then displaces the plate 16 in rotation about the axis A one or more times in the clockwise and/or anticlockwise direction (arrows 39). The consumer then displaces the member 18 in the slot 40 of the plate until it is over the selected zone. In the example of FIGS. 2 and 4, the wiping member 18 is aligned with the axis A and is placed above a central removal zone P in the receptacle. The consumer then holds the plate 16 firmly on the receptacle to retain the position of the wiping member 18 in the opening 24, then introduces the applicator 20 into this member to remove product from the zone P. When withdrawing the applicator, its tip 32 is wiped by the constriction of the member 18, which removes any surplus product being withdrawn. The consumer then applies the product to part of the body. If desired, the consumer can once again displace the member on the plate 16 and the plate on the receptacle 12, or vice versa, until the member 18 is in another position for removal from the receptacle 12.

Figure 5:
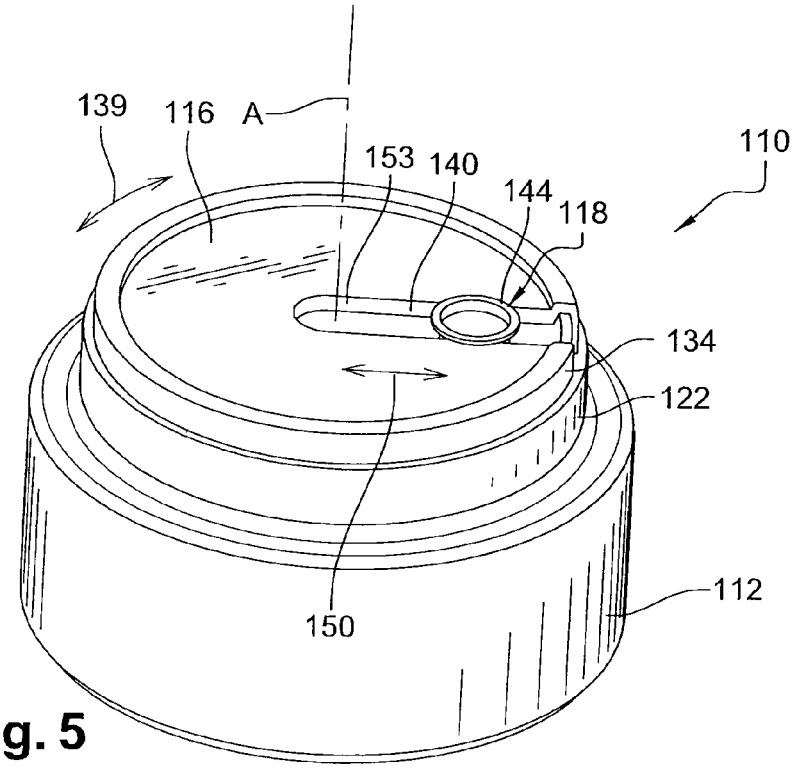
FIG. 5 is a perspective diagrammatic view in the production of a packaging item of one example of the invention.
Figure 6:
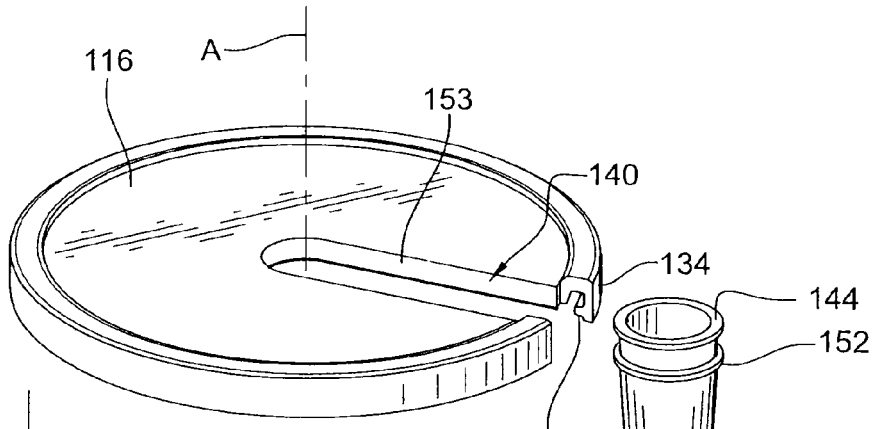
FIG. 6 is an exploded diagrammatic perspective view of the plate and the wiping member of the packaging item of FIG. 5.

In an embodiment shown in FIGS. 5 and 6, the packaging item 110 differs from that described above in that the slot 140 of the plate 116 opens at its radially outer end onto the outer rim 134 of the plate, and in that the wiping member 118 is mounted directly in this slot 140.

The wiping member 118 differs from that previously described in that it also includes a second outer annular rim 152 which extends parallel to the first outer rim 144 at a small axial distance therefrom. This outer rim 152 is formed on the outer cylindrical surface of the member 118.

The two rims 144, 152 of the member define between them an outer annular groove in which the edge 153 of the plate defining the slot 140 is slidably engaged. In the mounted position shown in FIG. 5, the rim 144 bears on the upper face of the plate and the rim 152 (not visible) bears on the lower surface of the plate. In an example, the axial distance between the rims 144, 152 is thus at least equal and preferably slightly greater than the thickness of the plate in its median portion.

In an example, the wiping member 118 may be mounted in the slot 140 of the plate as follows: the member 118 is positioned close to the radially outer end of the slot 140 and is radially aligned with this slot 140, as can be seen in FIG. 6. The member 118 is then displaced in the slot 140 in a direction perpendicular to the axis A until the edge 153 of the plate defining the slot 140 engages in the annular groove defined by the rims 144, 152 of the member 118. The plate 116 may then be fixed on the receptacle 112.

The other elements of the packaging item 110 which have already been described above have the same reference numerals increased by at least one hundred. This numbering principle is the same for the descriptions of the other variations below.

Figure 7:
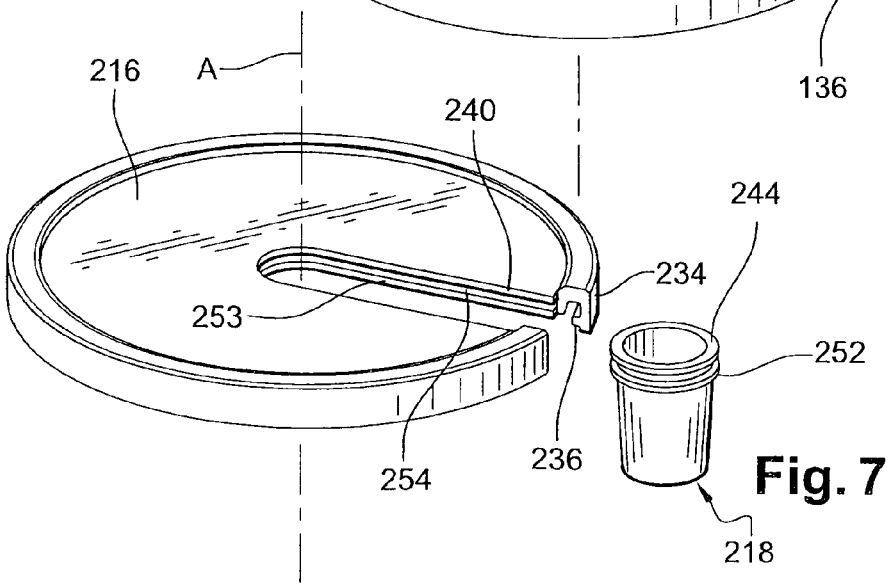
FIG. 7 is an exploded diagrammatic perspective view of the plate and the wiping member of another embodiment of the packaging item of the invention.

In an embodiment shown in FIG. 7, the plate 216 differs from the plate 116 in that it further includes an inner groove 254 formed in the edge 253 of the plate 216 defining the slot 240. This groove 254 extends along the edge, substantially at its centre and over its entire length.

The second outer rim 252 of the wiping member 218 is intended to be slidably engaged in this groove 254. In an example, the thickness or axial dimension of the rim 252 is at least equal to and preferably less than the thickness or the transverse dimension of the groove 254 of the plate.

The axial distance between the rims 244, 252 of the member here is preferably determined so that, in the mounted position, the outer rim 244 of the member is slidably supported on the upper face of the plate 216.

This plate 216 may be formed in one or two parts. In this latter case, the plate may include two disks fixed coaxially one on the other, each of these disks including a slot of the type described above and the disks defining between them at the edges of their slots the groove 254 cited above for mounting the wiping member 218.

The member 118, 218 of FIGS. 5 to 7 may also be formed for example from a single monoblock part or from two or more parts. The rim 152, 252 may, for example, be attached and fixed on the member or it may be formed at the same time as the member by dual injection, or again directly on the member by overmolding.

The packaging items shown in FIGS. 8 to 13 represent other variations of embodiments of the invention.

Figure 8:
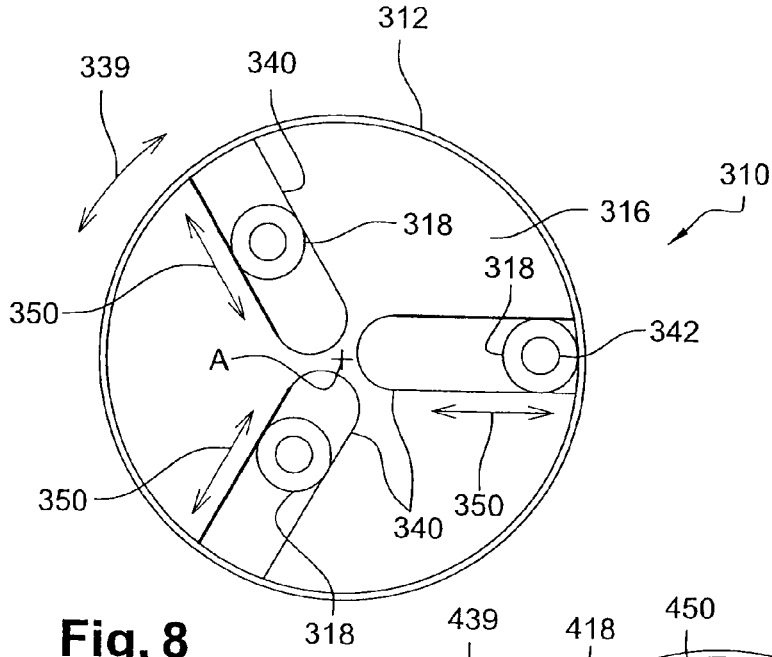
FIG. 8 is a diagrammatic top view of an example of a packaging item of the invention.

The packaging item 310 of FIG. 8 includes three wiping members 318 which are respectively housed in three radial slots 340 of the plate 316. The slots 340 can be of the type described in FIGS. 5 and 6 for example, and are distributed about the axis A of the opening of the receptacle 312 in a regular manner. Thus, they are spaced from each other by an angle of approximately 120° about the axis A. Each member 318 is displaceable in translation and in rotation in its slot independently of the other members (arrows 350). The members may define identical or different orifices 342 for passage of the applicator. The plate 316 is preferably movable in rotation on the receptacle 312 about the axis A (arrows 339).

Figure 9:
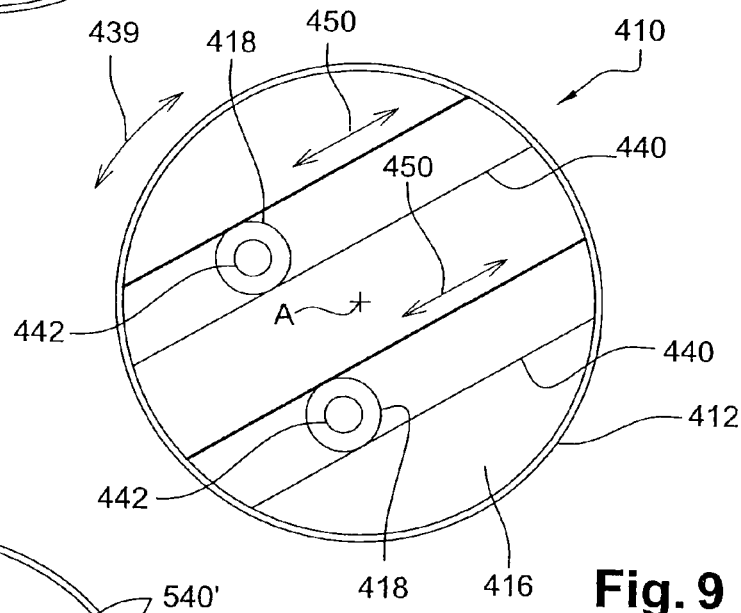
FIG. 9 is a diagrammatic top view of an example of a packaging item of the invention.

In the example of FIG. 9, the plate 416 includes two parallel slots 440 with a wiping member 418 (arrows 450) guided in each one. Furthermore, the plate 416 is displaceable in rotation on the receptacle 412.

Figure 10:
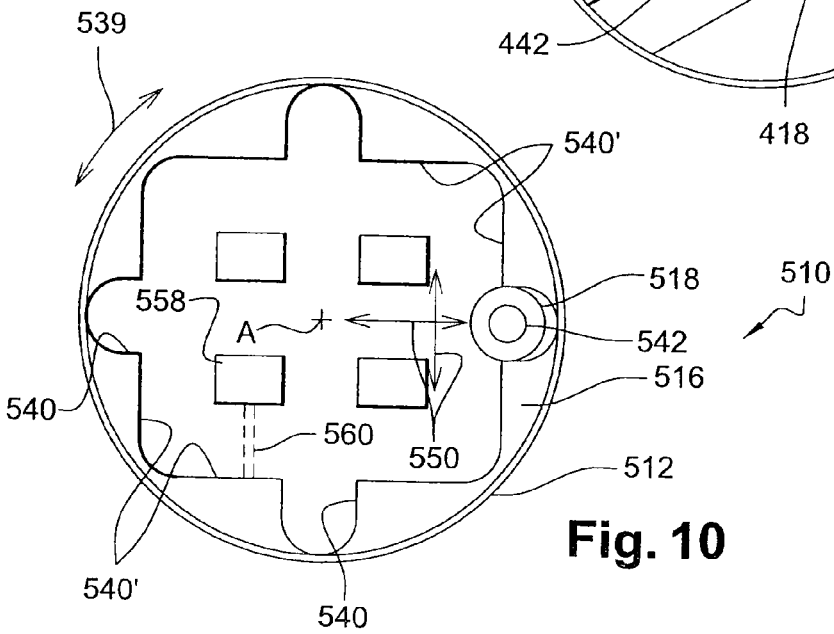
FIG. 10 is a diagrammatic top view of an example of a packaging item of the invention.

In the example of FIG. 10, the plate 516 of the packaging item 510 includes a plurality of slots 540, 540' in which a wiping member 518 can slide. In this example, there are six slots and they include two relatively long slots 540 which are connected together at their center at the axis A and which together form a + or X-shaped cross, and four slots 540' which are shorter and are connected together at their ends to form a rectangle or square extending about the axis A. The slots 540 pass through the slots 540' to form a network of slots with a clearly defined pattern which extends over the major portion of the section of the opening of the receptacle. In an example, the slots 540, 540' can have a constant width or transverse dimension such that the wiping member 518 can be displaced from one slot to another slot (arrows 550). The plate 516 is also displaceable in rotation about the axis A on the receptacle 512 (arrows 539).

Figure 11:
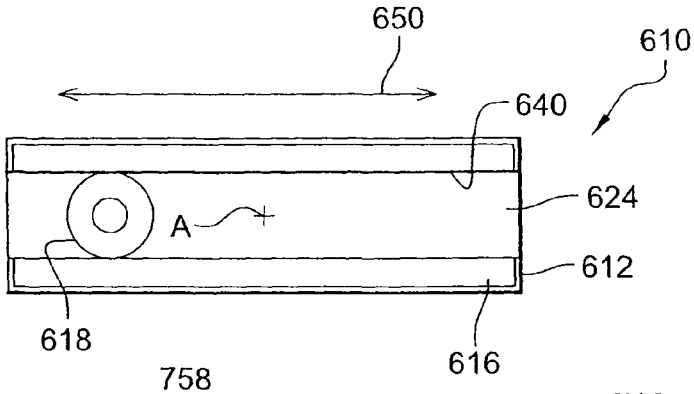
FIG. 11 is a diagrammatic top view of an example of a packaging item of the invention.
Figure 12:
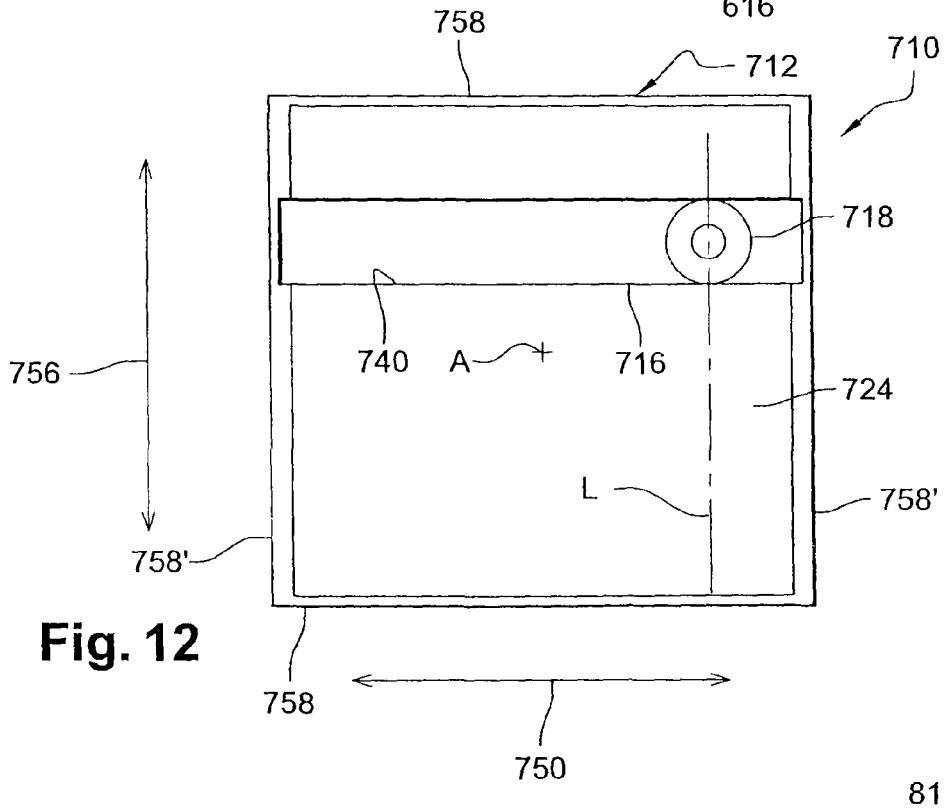
FIG. 12 is a diagrammatic top view of an example of a packaging item of the invention.
Figure 13:
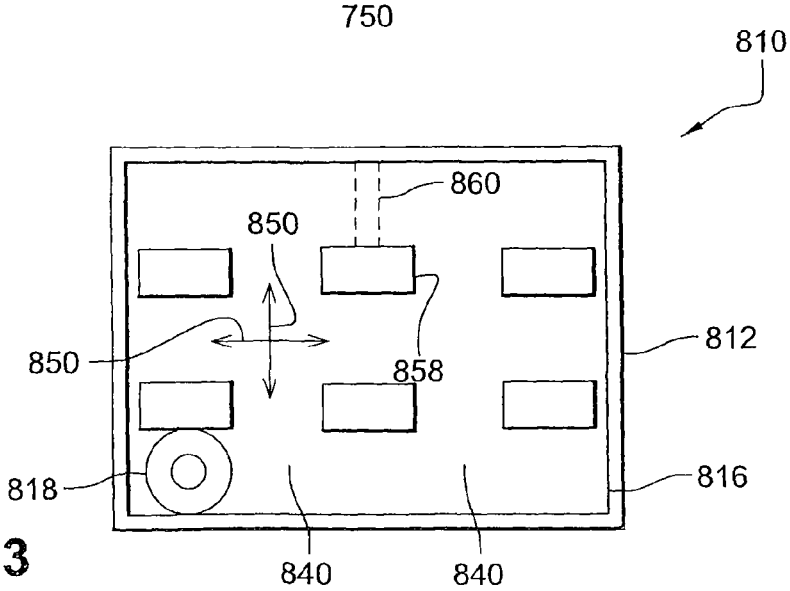
FIG. 13 is a diagrammatic top view of an example of a packaging item of the invention.

In the examples shown in FIGS. 11 to 13, the packaging item includes a receptacle with a generally parallelepipedal shape and includes an opening with a cross section which is substantially polygonal in shape, in particular substantially square or rectangular.

In the example of FIG. 11, the plate 616 has an elongate shape and covers the whole of the opening 624 of the receptacle 612. This precursor 616 includes a slot 640 which extends along the elongate axis of the plate and in which a wiping member 618 is guided. The wiping member 618 is displaceable in translation in the opening of the receptacle from one longitudinal end of this receptacle to the other (arrows 650).

In the variation of FIG. 12, the plate 716 is similar to that of FIG. 11 and is mounted on the receptacle 712 so as to cover only a portion of the opening 724 of this receptacle. Advantageously, the consumer can then see the product contained in the receptacle through the opening 724.

The plate 716 can have an elongate shape and extend parallel to two opposed side walls 758 of the receptacle 712. The plate 716 includes at its longitudinal ends two side rims (not visible) which cover the two other side walls 758' of the receptacle 712 and, for example, include pins (not shown) slidably engaged in outer grooves of the side walls 758'. The plate 716 is thus displaceable in translation on the receptacle 712 in a direction parallel to the walls 758' (arrows 756), from a position where it is situated in the immediate vicinity of one wall 758 of the receptacle to a position where it is located in the immediate vicinity of the other wall 758 of the receptacle. The plate 716 may be displaced into any intermediate position between these two extreme positions.

In an example, the plate is fixed in a removable manner on the receptacle 712 by elastic snap-fitting of its pins into the grooves of the lateral walls 758' of the receptacle 712. The other lateral walls 758 of the receptacle 712 can include grooves of the type cited above so that the plate 716 can be fixed either on the walls 758 or on the walls 758' when the receptacle 712 is square in shape. When the plate 716 is fixed on the walls 758, it is displaceable in translation in a direction parallel to these walls 758 (arrows 750). During displacement in translation of the plate 716 along the walls 758', the member 718 is displaced in translation along a line L in the opening 724 of the receptacle. The member 718 is also displaceable in the slot 740 of the plate in a direction perpendicular to the line L.

In an example shown in FIG. 13, the receptacle 812 is similar to that of FIG. 12 and the plate 816 includes several perpendicular slots 840 connected together so as to form a grid of slots in which a wiping member 818 can slide shown by arrows 850.

In the variations of FIGS. 10 and 13, the slots 840 of the plate 816 may be separated from each other by portions 558, 858 of the plate 816 which are connected to the remainder of the plate 816 via bridges of material (diagrammatically represented by the dotted lines 560, 860).

Figure 14:
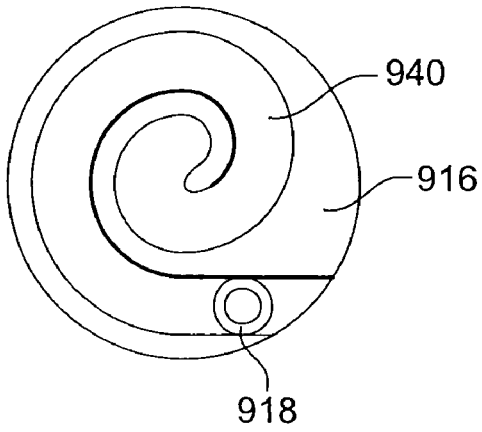
FIG. 14 is a diagrammatic top view of an example of a packaging item of the invention.

In the example shown in FIG. 14, the plate 916 includes a slot 940 in the form of a spiral one end of which is situated at the center of the plate 916 and the other end of which is situated at the periphery of the plate, at least one wiping member 918 can be displaceable in this slot 940.

Figure 15:
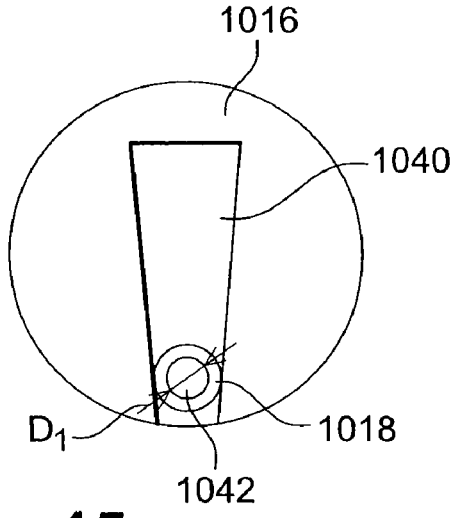
FIG. 15 is a diagrammatic top view of an example of a packaging item of the invention.
Figure 16:
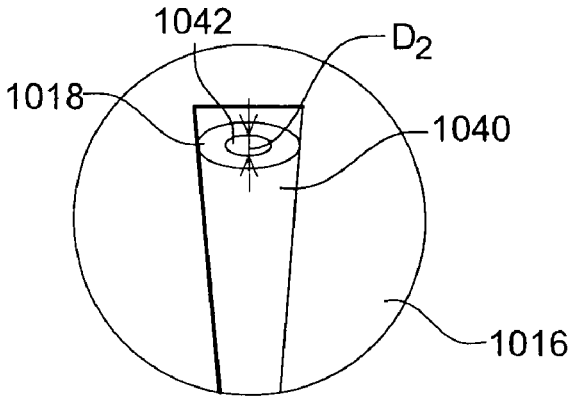
FIG. 16 is a diagrammatic top view of an example of a packaging item of the invention.

In yet another embodiment shown in FIGS. 15 and 16, the plate 1016 includes a rectilinear slot 1040 the width of which increases from one end to the other of the slot and in which a compressible and/or elastically extensible wiping member 1018 is displaceable in the transverse direction. The wiping member 1018 is at least partially produced from an elastically deformable material and is guided in the slot 1040 and held at its outer periphery by two diametrically opposed portions on the longitudinal borders of the slot 1040. In the case in which the wiping member 1018 is in the unconstrained state when it is situated at the end of the slot 1040 with the smallest width, it extends in a direction perpendicular to the elongation axis of the slot 1040 as it is displaced towards the end of the slot 1040 of greater width. This extension causes a deformation of the wiping member 1042 defined by the member which, in a direction substantially parallel to the direction of extension of the slot, has a dimension D2 which is less than the diameter D1 of this orifice when the member is in the unconstrained state. Advantageously, the applicator can wipe to a greater extent when it passes through this orifice 1042. In the case when the wiping member 1018 is in the constrained state when it is situated at the end of the slot 1040 with the smaller width, these constraints are released as it is displaced towards the end of the slot with the greater width, and the wiping orifice defined by the member widens slightly during this displacement.

In another variation which is not shown, the edge of the plate defining the slot comprises means for wiping the applicator. The plate is thus free of a wiping member of the type cited above, since the wiping means are formed directly on the plate. In the case in which the plate is movable on the receptacle, the consumer must displace the plate on the receptacle to a given position then select the portion of the slot of the plate through which the applicator is to be introduced. The applicator is then introduced through this portion of the slot then the applicator is removed from the slot.

In yet another variation which is not shown, the plate is formed in a single piece with the receptacle and the wiping member is movably mounted on the portion of the receptacle forming this plate.

Obviously, numerous modifications and variations of the present invention are possible in light of the above teachings. It is therefore to be understood that within the scope of the appended claims, the invention may be practiced otherwise than as specifically described.

The invention claimed is:

1. A packaging item for a cosmetic product, the packaging item comprising:

a receptacle provided with an opening and configured to contain a product; and a plate including a slot, the plate configured to be mounted on the receptacle and to carry at least one wiping member having an orifice through which an applicator may be passed to remove product from the receptacle, wherein the slot has an elongated shape and comprises a length larger than its width, said length being measured in a plane substantially perpendicular to an axis of the opening of the receptacle and to an axis of the opening of the wiping member, wherein the wiping member has an outer diameter or outer transverse dimension which is smaller than the length of the slot so as to occupy partially the slot, and wherein the wiping member is displaceable in the slot of the plate along its length and is configured to occupy different positions in the opening of the receptacle, said different positions allowing the product to be removed with the applicator from different portions of the receptacle.

2. The packaging item as claimed in claim 1, wherein the wiping member is movable in the slot of the plate in at least one direction, substantially perpendicular to an axis of the opening of the receptacle.

3. The packaging item as claimed in claim 1, wherein the wiping member is movable in at least one of rotation and translation in the slot of the plate.

4. The packaging item as claimed in claim 1, wherein the wiping member is guided by the slot of the plate.

5. The packaging item as claimed in claim 1, wherein said slot is substantially radial with respect to an axis of the opening of the receptacle.

6. The packaging item as claimed in claim 1, wherein the plate includes at least two slots which are spaced apart and substantially parallel to each other, a wiping member configured to be displaced in each slot.

7. The packaging item as claimed in claim 1, wherein the plate includes a plurality of slots which are connected together so that at least one wiping member can be moved from one slot to another in the plate.

8. The packaging item as claimed in claim 1, wherein the wiping member includes a ring configured to be engaged in the slot by elastic snap-fitting and to be slidably supported on an upper face and a lower face of the plate including the slot.

9. The packaging item as claimed in claim 1, wherein the wiping member includes two outer annular rims which are substantially parallel to and spaced apart from each other, one of said rims configured to be slidably supported on one face of the plate, and the other of said rims configured to be slidably supported on another opposed face of the plate or to be engaged in a slidable manner in an inner groove of an edge of the plate defining the slot.

10. The packaging item as claimed in claim 1, wherein the plate is movable in at least one of translation and rotation on the receptacle in a plane substantially perpendicular to an axis of the opening of the receptacle.

11. The packaging item as claimed in claim 1, wherein the plate carries two or three wiping members.

12. The packaging item as claimed in claim 1, wherein the plate has a circular, square or rectangular outer contour.

13. The packaging item as claimed in claim 1, wherein the plate covers at least a portion of the opening of the receptacle.

14. The packaging item as claimed in claim 1, wherein a plurality of slots are provided in a substantially radial direction with respect to the axis of the opening of the receptacle.

15. The packaging item as claimed in claim 1, wherein said slot is arcurate.

16. The packaging item as claimed in claim 1, wherein the wiping member includes a ring configured to be engaged in the slot, and wherein opposed faces of the plate forming the slot are not parallel.

17. A method for removing a product from a packaging item, the method comprising:

providing a receptacle including an opening, the receptacle configured to contain the product;

providing a plate including a slot, the plate configured to be mounted on the receptacle and to carry at least one wiping member having an orifice through which an applicator may be passed, wherein the slot has an elongated shape and comprises a length larger than its width, said length being measured in a plane substantially perpendicular to an axis of the opening of the receptacle and to an axis of the opening of the wiping member, and wherein the wiping member has an outer diameter or outer transverse dimension which is smaller than the length of the slot so as to occupy partially the slot;

moving the wiping member above an area of an internal portion of the receptacle;

inserting an applicator at least partially through the wiping member; and removing the applicator from the wiping member to remove product from the receptacle.

18. The method according to claim 17, further comprising:

displacement of the plate on the receptacle, wherein the wiping member is moved above the product contained in the receptacle by movement of the wiping member in the slot of the plate and by movement of the plate on the receptacle.

19. The method according to claim 18, further comprising:

rotating the plate on the receptacle; and moving the wiping member in at least one of rotation and translation in one or more slots of the plate.

20. The method according to claim 18, further comprising:

moving at least one wiping member within a corresponding at least one slot contained in the plate;

rotating the plate to a first position on the receptacle;

inserting an applicator into each of the at least one wiping members;

contacting the product with an end portion of the applicator;

removing the applicator from the wiping member to remove product from the receptacle;

rotating the plate to a second position on the receptacle different from the first position; and removing product from the receptacle.

* * * * *